US005354954A

United States Patent [19]

Peterson

[11] Patent Number: 5,354,954

[45] Date of Patent: Oct. 11, 1994

[54] DIELECTRIC MINIATURE ELECTRIC CABLE

[76] Inventor: Edwin R. Peterson, 4420 Hillcrest, Boise, Id. 83705

[21] Appl. No.: 105,372

[22] Filed: Jul. 29, 1993

[51] Int. Cl.[5] ..... H01B 7/08; H01B 13/00

[52] U.S. Cl. ..... 174/113 C; 156/50; 156/51; 174/108; 174/117 F; 174/126.1; 174/131 A

[58] Field of Search ..... 174/108, 113 C, 117 R, 174/117 F, 126.1, 128.1, 131 A; 156/50, 51

[56] References Cited

U.S. PATENT DOCUMENTS

| | | | |
|---|---|---|---|
| 2,438,006 | 3/1948 | Gustafson | 174/112 |
| 2,941,176 | 6/1960 | Jacoby | 338/262 |
| 3,037,068 | 5/1962 | Wessel | 174/69 |
| 4,082,585 | 4/1978 | Kanotz et al. | 156/51 |
| 4,090,763 | 5/1978 | Congdon et al. . | |
| 4,166,881 | 9/1979 | Congdon et al. | 428/463 |
| 4,313,645 | 2/1982 | Cocco . | |
| 4,503,285 | 3/1985 | Darms et al. | 428/458 |
| 4,567,321 | 1/1986 | Harayama | 174/117 F |
| 4,820,012 | 4/1989 | Asai . | |
| 4,835,340 | 5/1989 | Muz . | |
| 4,910,359 | 3/1990 | Dougherty et al. | 174/69 |

FOREIGN PATENT DOCUMENTS

| | | |
|---|---|---|
| 2851595 | 11/1979 | Fed. Rep. of Germany . |
| 3516708 | 11/1986 | Fed. Rep. of Germany . |

*Primary Examiner*—Morris H. Nimmo

*Attorney, Agent, or Firm*—Frank J. Dykas; Craig M. Korfanta

[57] ABSTRACT

A multiple conductor electric cable (10) having a plurality of conductors (12), each formed of a multi-filament tensile core (14) of unbonded aramid fibers (16). The conductors (12) further have at least a pair of tinsel conductor ribbons (18, 20), spirally wrapped in the same direction about tensile core (14). Further, conductors (12) are arranged in an orientation wherein the spiral wraps of conductor tinsel in each conductor (12) are in alternating directions from one conductor (12) to the next within a thermoplastic insulating jacket (22), which is further encased within polyester jacket (26).

23 Claims, 5 Drawing Sheets

DIELECTRIC MINIATURE ELECTRIC CABLE

RELATED APPLICATIONS

This application is a continuation-in-part application of application PCT/US92/07452 filed Sep. 3, 1992.

BACKGROUND OF THE INVENTION

1. Technical Field

This invention relates to a small size electric cable primarily for telephone, data and other signal transmissions and to a small size electric cord for carrying household current, where cable tensile strength, flexibility, flat cable ductility and high dielectric strength insulation are the major concerns.

2. Background Art

In the electronics field there is a general class of flexible cables known as tinsel cables. Tinsel cables are used in applications where great flexibility for the cable is required. Generally they are constructed by spiral wrapping a tensile foil of conductive material, usually copper or copper alloy, around a tensile filament or element, usually nylon or polyester. The wire is then coated with a thermoplastic insulating material. The required number of independent wires are then arranged in a ribbon and jacketed with a second plastic material to form a multi-wire, flexible cable, which can be subjected to repeated flexure without fatiguing the conductive tensile metal foil.

In the past, the primary structural member able to withstand tensile stress in these prior art flexible cables was the plastic jacket. However, there were present couple of trade-offs, the first between tensile strength of the cable and ductility, and the second between the decreasing cross-sectional area of the jacket and its dielectric strength. In order to assure a flexible cable having high tensile strength, the cross-sectional area of the plastic jacket was increased, which resulted in a decrease in ductility. Conversely, as the cables were miniaturized by minimizing the cross-sectional area of the plastic jacket, ductility increased but tensile strength decreased. At the dimensional sizes taught by the present invention, there is insufficient plastic material in the plastic jacket to be of any significant use as a structural member able to withstand even moderate tensile stress or to provide enough dielectric strength for safety purposes.

To compensate for the loss of tensile strength resulting from miniaturization or reduction in the cross-sectional area of the plastic jacket, aramid fibers from the family of aromatic polyamides were substituted for the nylon and polyester filaments used in the past. These aromatic polyamides have, in addition to high tensile strength, another favorable property over the older nylon and polyester filaments, namely they are relatively inelastic. Nylon and polyester tensile filaments are subject to elongation factors of ten percent at strain forces of a mere 4 grams/denier (35 cN/Tex) and will break at force levels of approximately 8 grams per denier (70 cN/Tex). These forces can be easily incurred in miniature cables by inadvertently tugging on the cable or, in a localized fashion, merely by folding and crimping the cable.

The elasticity of the nylon and polyester filaments cause problems with single wraps of tinsel when wrapped in a helical spiral fashion about each filament, in that the elasticity of the filament greatly exceeded that of the copper or the copper alloy tinsel foil. This resulted in a loss of, or reduced, conductivity and eventual breakage of the cable.

To compensate for this, it is standard practice in the industry to provide for two wraps of tinsel foil about each cable. To insure electrical conductivity, each of these wraps is, as taught in the prior art, wrapped in a helically spiral opposite to the other, that is to say, one in a clockwise direction, and the other in a counterclockwise direction to solve the problem of maintaining good conductivity under conditions of tensile stretching in cables having nylon or polyester tensile filaments.

The opposing spiral design, originally adopted to compensate for tensile stretching, has been carried over into the new non-elastic tensile filament cables using aromatic fibers. But this design has an inherent defect, in that if the cable is twisted, it will wrap the helical spiral of tinsel tighter in one direction, and unwrap the tinsel foil which was wrapped in the other direction. This results in an abrasion of metal-to-metal rubbing between the two helical spiral wraps. In practice it has been found that there is a significant amount of abrasion between the opposing spiral wraps, and eventual cutting of the outer wrap into the inner wrap and a resulting loss of conductivity or cable failure.

In practice it has been found that if both wraps of tinsel foil are made in the same direction, there is less abrasion, better conductivity, and an extended cable life. However, unidirectional double wrapping is not done because it induces a torsional stress into the conductive wire in the opposite direction from that in which the coils are wrapped, by reason of the coils tending to unwrap themselves from the filament. In cases of extremely ductile miniature cables, this actually can result in a multi wire cable assuming a helical spiral in a direction opposite that to which the tinsel is wrapped inside the cable.

Accordingly, it is an object of this invention to provide a miniature electric cable of high tensile strength, small cross-sectional area, with maximum wear unidirectional multiple layered spirals of conductive tinsel foil that will lie flat even though it is extremely ductile. Additionally, it is an object of this invention to provide a miniature cable of high dielectric strength, small cross-sectional area, with maximum wear unidirectional multiple layered spirals of conductive tinsel foil that will lie flat even though it is extremely ductile.

DISCLOSURE OF INVENTION

These objects are achieved through a multiple conductor electric cable containing at least two conductors held in parallel spaced relationship within a first flexible thermal plastic jacket formed from the family of polyether amides and a second jacket made of polyester. Each of the conductors has a tensile element formed of a plurality of unbonded filaments of aramid fiber from the family of aromatic polyamides. Spirally wrapped about each of the tensile filaments are at least two tinsel ribbons. Both tinsel ribbons are wrapped in the same direction, with one overlaying the other.

The conductors are placed into an array within the thermal plastic jacket in an orientation such that the spiral wraps of tinsel foil in each conductor is in an opposite direction, one conductor to another, so as to cancel out the twisting forces induced by the wraps of tinsel foil about the filaments. This intermediate cable is then dipped in an insulating polyester varnish and pulled through a heater stack to dry and cure the varnish. These cables, even though extremely ductile and pliable, will lie flat when not under tensile load and exhibit upwards of a four fold increase in dielectric strength.

BEST MODE FOR CARRYING OUT INVENTION

Figure 1:
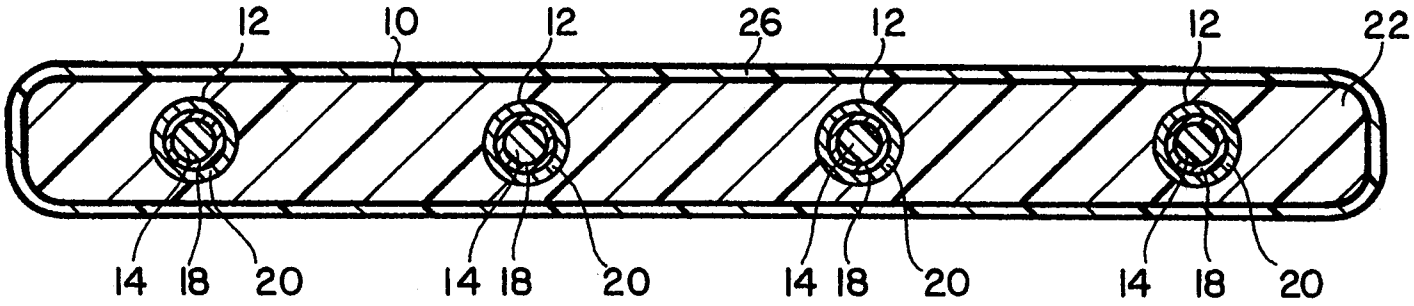
FIG. 1 is a greatly enlarged cross sectional view of the cable.
Figure 2:
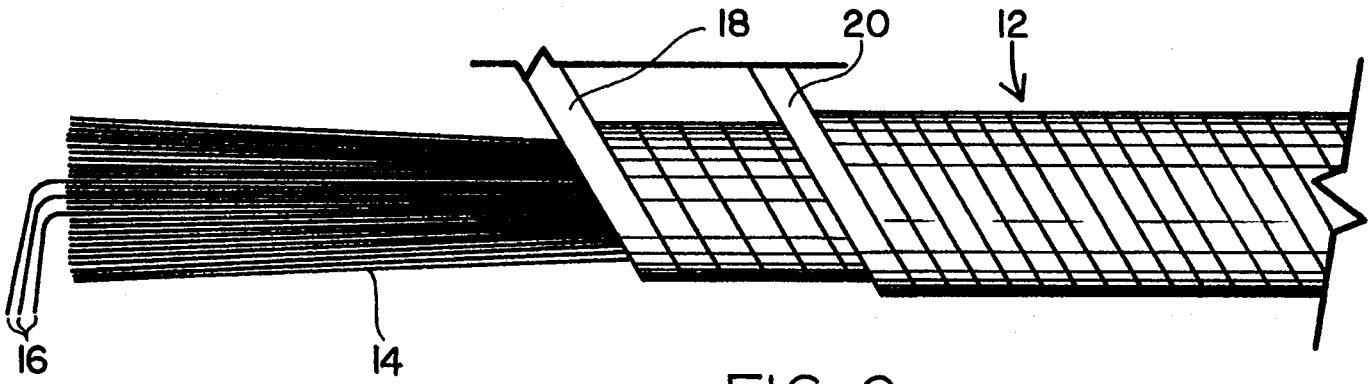
FIG. 2 is a detailed top view of a single conductor for a first configuration for the conductors.
Figure 3:
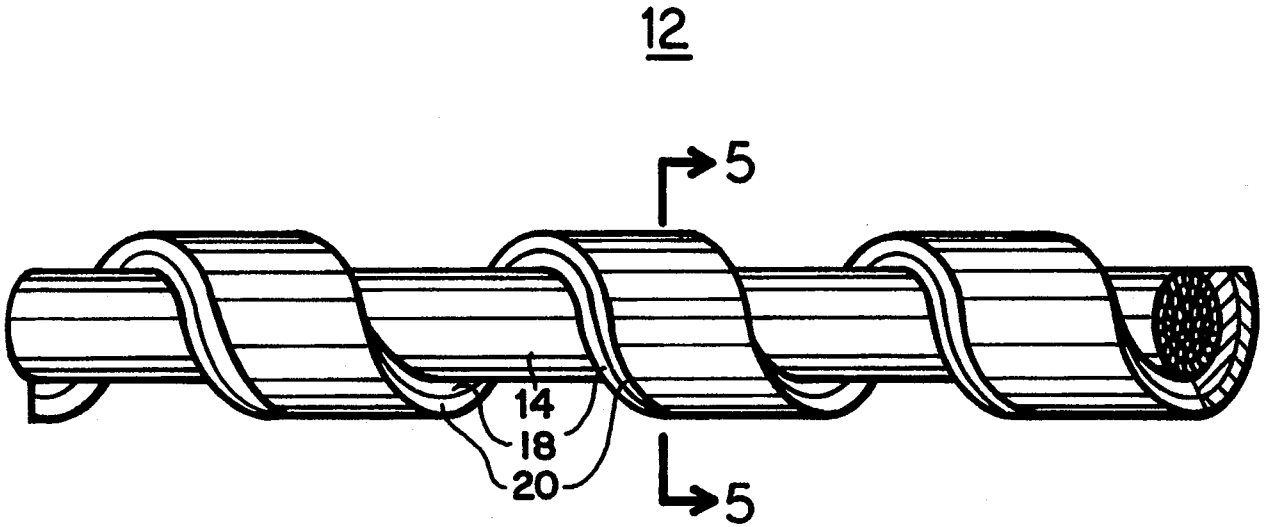
FIG. 3 is a detailed top view of a single conductor for a second configuration for the conductors.

FIG. 1 shows a greatly enlarged view of multiple conductor electric cable 10 containing four parallel, spaced apart conductors 12, held within extruded thermoplastic jacket 22 and polyester jacket 26 to form a flexible multiple conductor cable 10. In the present embodiment each conductor 12 has a tensile core 14 comprised of a plurality of separate unbonded filaments 16 around which is wrapped a first tinsel ribbon 18, and then wrapped in the same direction and overlaying first tinsel ribbon 18, a second tinsel ribbon 20 as shown in FIGS. 2 and 3. FIG. 3 shows a second configuration for the two tinsel ribbons 18 and 20, which has them wrapped around filaments 16 with consecutive wraps being spaced apart from one another. This gives cable 10 additional flexibility. For purposes of illustration in this specification, electric cable 10 contains four conductors 12, however, it should be apparent that the principles taught herein are equally applicable to any flexible multiple conductor cable of small dimensional cross-section, particularly cables having an approximate thickness of less than forty thousandths of an inch and an approximate width of less than fifty thousandths of an inch per conductor.

Tensile filament core 14 of each conductor 12 is fabricated of a plurality of separate unbonded filaments 16 of an aramid fiber from the family of aromatic polyamides. In the preferred embodiment, this is preferably KEVLAR®, which is a registered trademark of the DuPont Corporation. The aramid fibers are much less susceptible to elongation, suffering approximately 1% elongation at 4 grams/denier (35 cN/Tex) and have a much higher resistance to breakage, at 22 grams/denier (194.2 cN/Tex), which is almost three times stronger than that found in a conductor using conventional nylon tinsel filaments.

In the preferred embodiment, each of tensile cores 14 in four conductor cable 10 has a cross-sectional area of 7.74 square millimeters. Tinsel ribbons, 18 and 20, are at least 98% copper and the remainder cadmium, but preferably they are 1% cadmium and 99% copper. They are 0.05 mm thick and 0.508 mm wide, although other alloys of copper or other conductive materials may be used.

The preferred extruded insulating thermoplastic material 22 is a thermoplastic selected from the family of polyether amides, and this is preferably PEBAX®, which is a registered trademark of ATOCHEM, Inc. This is an extremely flexible material. Polyester jacket 26 is made from a polyester varnish, here ISONEL® 31-398, an insulating polyester varnish manufactured by Schenectady Chemicals, Inc.

The centers of the four parallel conductors 12 are spaced apart from each other forty thousandths of an inch and encased in thermoplastic material 22 to form an intermediate construction having thickness of approximately nineteen thousandths of an inch. Each conductor 12 is approximately ten thousandths of an inch in diameter. The intermediate construction is then coated with a polyester insulating varnish layer of 0.5 thousandths of an inch in thickness resulting in finished cable 10 having an approximate thickness of twenty thousandths of an inch and an approximate width of fifteen hundredths of an inch. In this configuration, each of the conductors 12 have a tensile strength of 40N to 44.5N, for a combined cable strength of 160N to 178N. This compares to a standard cable using a nylon tensile core of comparable size which would have a tensile strength of only between 53N to 67N.

Similarly, a two conductor embodiment of cable 10 for carrying household current uses conductors 12 having an approximate diameter of fifteen thousandths of an inch and a total thickness, including both the thermoplastic encasement and the polyester insulating varnish coating, of approximately thirty thousandths of an inch.

While first and second tinsel ribbons 18 and 20 are formed of a relatively ductile material, there is some residual elasticity and as a result there is an inherent twisting force induced as a result of the tendency of the tinsel strips attempting to unwrap themselves from tensile filament core 14. In the past, the prior art solution adopted to eliminate this twist induced by the tendency to unwrap has been to wrap the first conductive tinsel foil spirally in one direction about tensile core 14, and the second conductive tinsel ribbon in the opposite direction, thus canceling the induced tendency for the wire to twist. However, it has been found in practice that the tinsel ribbons slide over each other as electrical conductor cable 10 is repeatedly bent, causing a chafing and fractures resulting from the friction, which can eventually lead to fatigue and failure of the conductors. It has been found in practice that if both tinsel ribbons 18 and 20 are wrapped in the same direction, this frictionally induced fracture and failure is greatly reduced, thus extending the useful life of the cable.

However, as previously stated, wrapping both conductive tinsels 18 and 20 in the same direction does not provide for any means to cancel out the induced twist in conductors 12. It has been found in practice that if conductors 12, as taught in the present invention, were formed into multiple conductor electric cable 10, in an array wherein the spiral wrappings of conductive material for each of the conductors 12 were each wrapped in the same direction, it will actually induce a loose helical twist into cable 10 to the extent that the cable will not lay flat when not under tensile load.

Figure 4:
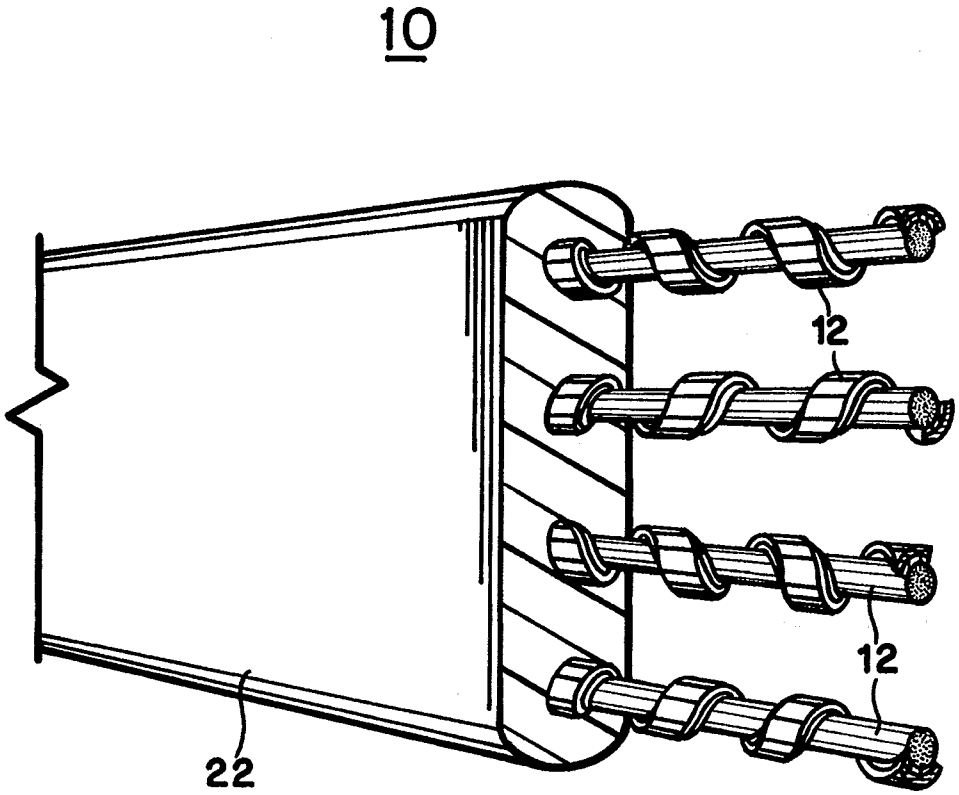
FIG. 4 is a schematic top view illustrating the alternating pattern of wrapping the conductive foil on the parallel conductors.
Figure 6:
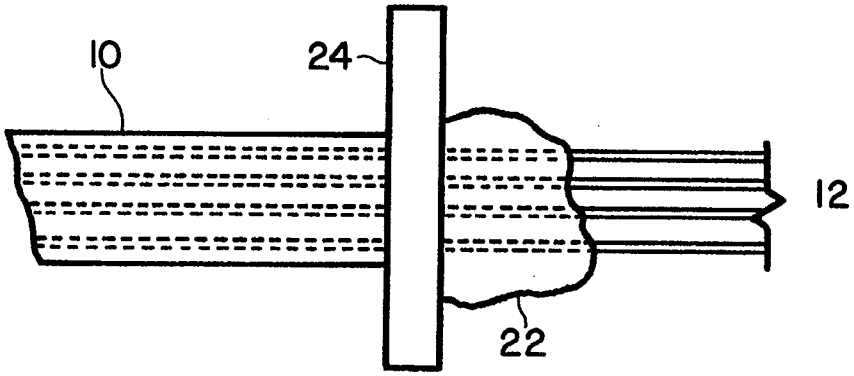
FIG. 6 is a schematic representation showing the extrusion of a four conductor cable.
Figure 5:
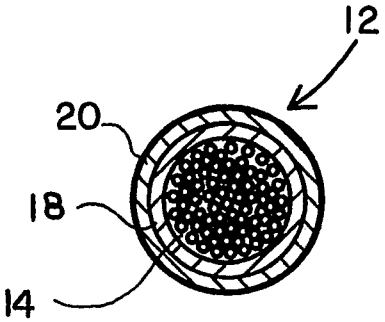
FIG. 5 is a cross-sectional view of one of the conductors.
Figure 7:
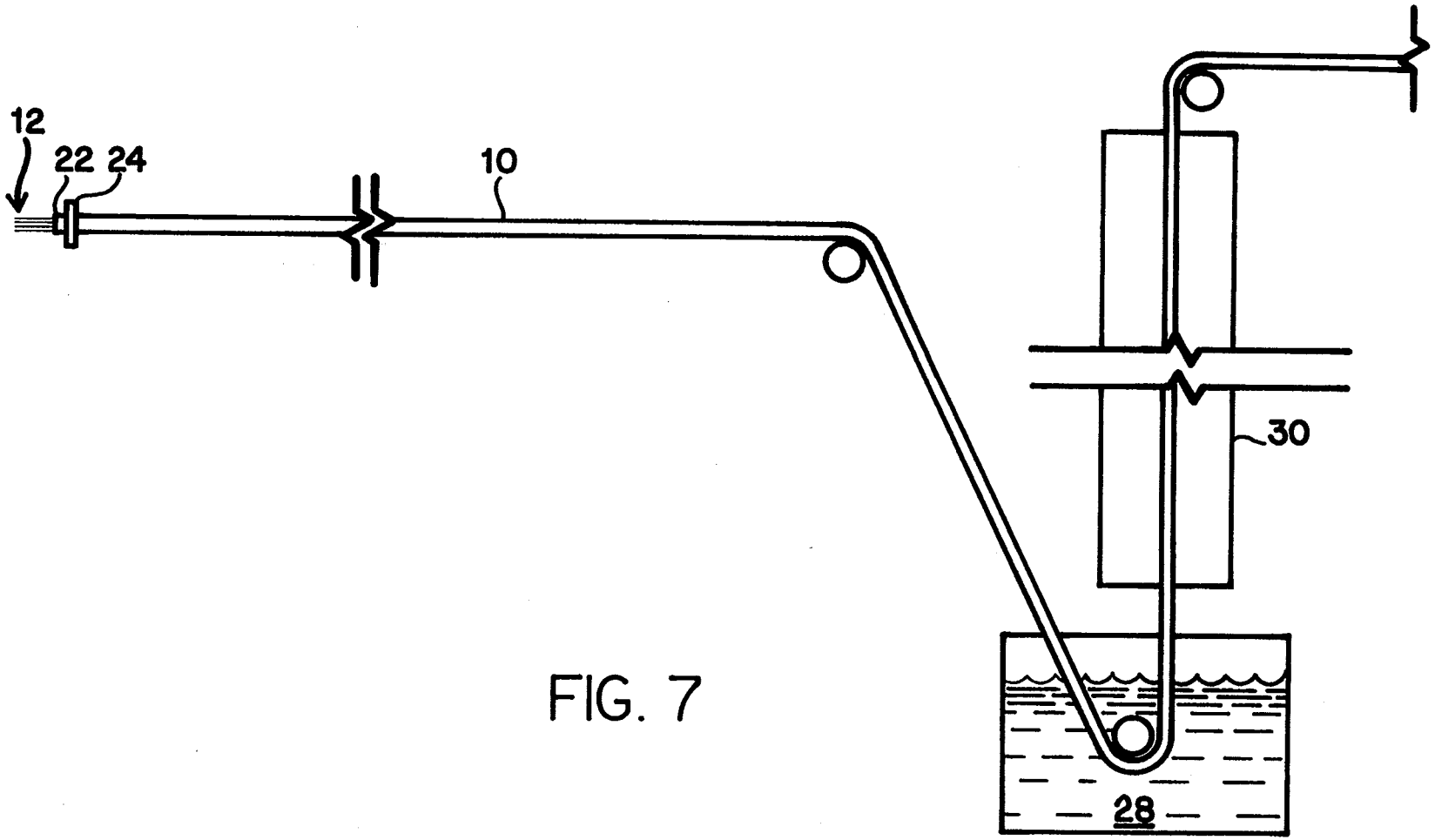
FIG. 7 is a schematic representation of a method for manufacturing the invention.

Since no torque canceling forces are provided by the double wraps of tinsel in the same direction, the conductors 12 are oriented within the array of cable 10, such that the orientation of the wraps of conductive tinsel of each conductor are arranged in alternating directions from one conductor to the next. This is shown in FIG. 4, and it provides the necessary canceling forces to eliminate the tendency of the cable to twist. FIG. 6 illustrates the extrusion process to produce four conductor cable 10 as shown in FIG. 1. The four conductors 12 are fed in parallel spaced relationship in the orientation of alternating directions of spiral wrapping of a conductive tinsel, through molten block polyamide thermoplastic material 22 in extrusion die 24. The resulting extrusion is then fed through a polyester varnish filled vat 28 in which the cable is dipped, as is shown in FIG. 7. The dipped cable is then cured in heated stack 30 as it passes through. The one-half mil thick coating of ISONEL® 31-398 must be cured for one to two hours at a temperature of 275–325 nF.

The result is multiple conductor electric cable 10 which is extremely flexible, has a low elongation factor, has a high dielectric strength, and more resistant to loss of conductivity by fracture and fatigue of tinsel coils 18 and 20, yet at the same time will still lie completely flat when not under tensile load.

While there is shown and described the present preferred embodiment of the invention, it is to be distinctly understood that this invention is not limited thereto but may be variously embodied to practice within the scope of the following claims.

I claim:

1. A multiple conductor electric cable characterized by:

a plurality of conductors each comprising a central core of least one tensile load bearing filament surrounded by a plurality of overlaid, spirally wrapped, strips of conductive material with each of the strips of conductive material for each conductor spirally wrapped about the strand of filaments in the same direction, and with each of said conductors arranged in a parallel array in spaced apart relationship wherein the direction of the spiral wrappings of conductive material of each of the conductors of the array are arranged in an orientation of alternating directions from one conductor to the next;

said parallel array of conductors being held within a thermoplastic insulating jacket, and said thermoplastic insulating jacket being held in a polyester jacket of cured insulating varnish.

2. The multiple conductor electric cable of claim 1 wherein said tensile load bearing filaments are characterized as unbonded multi-filament strands of tensile load bearing fibers.

3. The multiple conductor electric cable of claim 2 wherein said unbonded multi-filament strands of tensile load bearing fibers are further characterized as aramid fibers.

4. The multiple conductor electric cable of claim 3 wherein said thermoplastic insulating jacket is further characterized as a block polyamide.

5. The multiple conductor electric cable of claim 4 wherein the conductive material is characterized as an alloy formed of at least ninety eight percent copper and the remainder of cadmium.

6. The multiple conductor electric cable of claim 3 wherein the conductive material is characterized as an alloy formed of at least ninety eight percent copper and the remainder of cadmium.

7. The multiple conductor electric cable of claim 2 wherein the conductive material is characterized as an alloy formed of at least ninety eight percent copper and the remainder of cadmium.

8. The multiple conductor electric cable of claim 1 wherein the conductive material is characterized as an alloy formed of at least ninety eight percent copper and the remainder of cadmium.

9. The multiple conductor electric cable of claim 2 wherein said thermoplastic insulating jacket is further characterized as a block polyamide.

10. The multiple conductor electric cable of claim 1 wherein said thermoplastic insulating jacket is further characterized as a block polyamide.

11. The multiple conductor electric cable of claim 1 wherein said unbonded multi-filament strands of tensile load bearing fibers are further characterized as aramid fibers.

12. A multiple conductor electric cable characterized by:

a plurality of conductors each comprising a central core of at least one tensile load bearing filament surrounded by a plurality of overlaid, spirally wrapped, strips of conductive material with each of the strips of conductive material for each conductor spirally wrapped about the strand of filaments in the same direction, and with each of said conductors arranged in a parallel array in spaced apart relation at a distance less than fifty thousandths of an inch per conductor, wherein the direction of the spiral wrappings of conductive material of each of the conductors of the array are arranged in an orientation of alternating directions from one conductor to the next;

said parallel array of conductors being held within a thermoplastic insulating jacket;

said thermoplastic insulating jacket being held in a polyester jacket of cured insulating varnish to form a complete cable assembly; and the complete cable assembly having a total thickness of less than forty thousandths of an inch.

13. The multiple conductor electric cable of claim 12 wherein said tensile load bearing filaments are characterized as unbonded multi-filament strands of tensile load bearing fibers.

14. The multiple conductor electric cable of claim 13 wherein said unbonded multi-filament strands of tensile load bearing fibers are further characterized as aramid fibers.

15. The multiple conductor electric cable of claim 14 wherein said thermoplastic insulating jacket is further characterized as a block polyamide.

16. The multiple conductor electric cable of claim 15 wherein the conductive material is characterized as an alloy formed of at least ninety eight percent copper and the remainder of cadmium.

17. The multiple conductor electric cable of claim 14 wherein the conductive material is characterized as an alloy formed of at least ninety eight percent copper and the remainder of cadmium.

18. The multiple conductor electric cable of claim 13 wherein the conductive material is characterized as an alloy formed of at least ninety eight percent copper and the remainder of cadmium.

19. The multiple conductor electric cable of claim 12 wherein the conductive material is characterized as an alloy formed of at least ninety eight percent copper and the remainder of cadmium.

20. The multiple conductor electric cable of claim 13 wherein said thermoplastic insulating jacket is further characterized as a block polyamide.

21. The multiple conductor electric cable of claim 12 wherein said thermoplastic insulating jacket is further characterized as a block polyamide.

22. The multiple conductor electric cable of claim 12 wherein said unbonded multi-filament strands of tensile load bearing fibers are further characterized as aramid fibers.

23. A method of manufacturing a multiple conductor electric cable comprising the steps of:

wrapping a first bundle of unbonded multi-filament fibers in a first direction with a first pair of overlaying continuous strips of conductive material to form a first conductor;

wrapping a second bundle of unbonded multi-filament fibers in a second direction, opposite to the first, with a second pair of overlaying continuous strips of conductive material to form a second conductor;

encasing the first and second conductors in a thermoplastic insulating jacket by passing the conductors and thermoplastic material through an extrusion die;

coating the thermoplastic insulating jacket in an insulating polyester varnish; and curing the polyester varnish coating.

* * * * *